US006386537B1

(12) United States Patent
Howard et al.

(10) Patent No.: US 6,386,537 B1
(45) Date of Patent: May 14, 2002

(54) SHEET ACCUMULATOR WITH DIVERTING MECHANISMS

(75) Inventors: Linda A. Howard, Brookfield; Edward M. Ifkovits, New Fairfield; Eric J. Janatka, Danbury; Shahzad H. Malick, Fairfield, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/548,402

(22) Filed: Apr. 13, 2000

(51) Int. Cl.[7] ..... B65H 29/62
(52) U.S. Cl. ..... 271/303; 270/52.02; 414/790.7
(58) Field of Search ..... 271/198, 303–305, 271/265.01; 270/52.02; 414/790.3, 790.7

(56) References Cited

U.S. PATENT DOCUMENTS

| | | | | | |
|---|---|---|---|---|---|
| 4,235,434 | A | | 11/1980 | Muller | 271/280 |
| 4,318,484 | A | * | 3/1982 | Stiernspetz | 209/534 |
| 4,499,834 | A | | 2/1985 | Ruetchle et al. | 112/2 |
| 4,640,506 | A | * | 2/1987 | Luperti et al. | 271/245 X |
| 4,925,180 | A | * | 5/1990 | Golicz | 414/790.7 X |
| 5,000,657 | A | * | 3/1991 | Gunther, Jr. | 414/790.3 |
| 5,083,769 | A | | 1/1992 | Young, Jr. et al. | 271/280 |
| 5,183,246 | A | | 2/1993 | Edwards et al. | 270/45 |
| 5,280,902 | A | | 1/1994 | Helmstadter | 271/198 |
| 5,342,038 | A | * | 8/1994 | Suter | 271/305 X |
| 5,364,085 | A | | 11/1994 | Kennish | 270/58 |
| 5,398,919 | A | | 3/1995 | Suter | 270/58 |
| 5,472,181 | A | | 12/1995 | Lowell | 270/53 |
| 5,590,873 | A | | 1/1997 | Smart et al. | 271/303 |
| 5,623,722 | A | | 4/1997 | Hawley et al. | 399/397 |
| 5,647,587 | A | | 7/1997 | Smart et al. | 271/223 |
| 5,692,745 | A | | 12/1997 | Neifert et al. | 271/198 |
| 5,775,689 | A | | 7/1998 | Moser et al. | 271/198 |
| 5,794,931 | A | | 8/1998 | Heilman et al. | 271/303 |
| 6,244,419 | B1 | * | 6/2001 | Slocum | 271/303 X |

* cited by examiner

*Primary Examiner*—Christopher P. Ellis
*Assistant Examiner*—Patrick Mackey
(74) *Attorney, Agent, or Firm*—Christopher J. Capelli; Angelo N. Chaclas

(57) ABSTRACT

A system and corresponding method for accumulating sheets as part of the operation of a mailing system and for conveying the sheets along a normal feed path, and including a mis-scan diverter for diverting sheets that have been mis-scanned from a normal feed path to a first alternate path, and a selective diverter for diverting selective document sets from the normal feed path to a second alternate path. In some applications, the selective diverter includes a pivot table by-pass guide positioned according to commands received from a selective controller so as to selectively divert a sheet. Such a selective diverter uses a nip formed at the distal end of the pivot table by-pass guide by a continuously running cooperating roller and a surface of the pivot table by-pass guide, so that a sheet entering the nip so formed is diverted to the second alternate path. In some applications, the mis-scan diverter includes a diverting chute assembly that is made to rise up into the feed path so that a sheet enters the diverting chute assembly and is thereby provided to the first alternate path, the diverting chute assembly being raised and lowered under the command of a mis-scan controller.

5 Claims, 10 Drawing Sheets

11
62
25
32d
61

SHEET ACCUMULATOR WITH DIVERTING MECHANISMS

TECHNICAL FIELD

The present invention pertains to feeding individual sheets seriatim, as part of the processing of a mailing system, and more particularly to feeding sheets to an accumulator from which the sheets can be directed on to various paths in the mailing system.

BACKGROUND OF THE INVENTION

Various accumulator apparatuses and methods have been employed in the prior art for accumulating sheet materials or articles such as paper sheets, documents, and the like into stacks for subsequent advancement. Such accumulator systems are used in particular in high-speed mail processing, where preparing and processing mailable articles often requires a set of sheet articles (a collation) to be assembled into a stack (packet) for further handling, which can include folding, inserting, and collating.

It is essential in a high-speed mailing system that processing paths be arranged to pose as low a risk as is feasible of a sheet causing a jam. To arrive at a design for processing sheets, a combination of tradeoffs are made. In one approach to designing an accumulator that is especially unlikely to cause a sheet to jam, the accumulator might be specialized to particular size sheets or to sheets with particular bending properties (relevant for folding the sheets). In such a design, it is advantageous to provide for selectively diverting some sheets in case they are different from the kind intended for a normal processing path.

Even if a jam does not occur, however, it is sometimes necessary to divert sheets from the normal processing path, such as in case where a sheet has been mis-scanned by a bar code reader because, for example, the bar code is not clearly inscribed.

Thus, what is needed is a system for accumulating sheets in a manner that poses an especially low risk of any problem in processing at least some kinds of sheets, and that conveys a stack of accumulated sheets along either a normal processing path or an alternative processing path, and that also provides for diverting sheets in case of a problem with the sheets.

SUMMARY OF THE INVENTION

Accordingly, the present invention provides a system for accumulating sheets as part of the operation of a mailing system and for conveying the sheets along a normal feed path, the system including: a sheet feeder for feeding sheets seriatim; a bar code reader, responsive to bar code indicia on the sheets, for providing a bar code scanned signal; a receiving bin for receiving and stacking the sheets in a bin receptacle; a registration and jogging module for stopping the sheets over the receiving bin so that they fall properly into the bin receptacle, and further for edge-aligning the sheets in the bin receptacle, and still further for ejecting sheets out of the receiving bin along the normal feed path; a mis-scan controller, responsive to the bar code scanned signal, for providing mis-scan diverter commands for sheets that have been mis-scanned; a mis-scan diverter, coupled to the receiving bin, responsive to the mis-scan diverter commands, for diverting those sheets that have been mis-scanned from the normal feed path to a first alternate path; a selective controller, responsive to the bar code scanned signal, for providing selective diverter commands for diverting sheets selectively; and a selective diverter, coupled to the receiving bin, responsive to the selective diverter commands, for diverting selective document sets from the normal feed path to a second alternate path.

In a further aspect of the invention, the receiving bin of the accumulator includes: a free running idler roller mounted on a low-angle ramp that rises toward a continuously running belt, the free-running idler mounted at the end of the low-angle ramp closest to the continuously running belt, and disposed so as to form a nip with the continuously running belt, thereby arranging that sheets are provided to the receiving bin in a substantially planar feed path.

In another, further aspect of the invention, the registration and jogging module includes: a pusher assembly including a stepper motor for back and forth jogging of the sheets accumulating in the receiving bin, and two rollers driven by the stepper motor via a timing belt, and also including at least one pusher member located on the timing belt; and a stop assembly including a stepper motor for back and forth jogging, and two rollers driven by the stepper motor via the timing belt, and also including at least one stop member affixed to the timing belt and disposed so that as sheets are fed into the receiving bin 1*a* they strike the stop member and fall into the bin receptacle where they are then jogged and edge-aligned.

In yet another, further aspect of the invention, the selective diverter includes a pivot table by-pass guide positioned according to commands received from a selective controller so as to selectively divert a sheet. In such an embodiment, a nip is formed at the distal end of the pivot table by-pass guide by a continuously running cooperating roller and a surface of the pivot table by-pass guide, so that a sheet entering the nip so formed is diverted to the second alternate path.

In yet even another, further aspect of the invention, the mis-scan diverter includes a diverting chute assembly that is made to rise up into the feed path so that a sheet enters the diverting chute assembly and is thereby provided to the first alternate path, the diverting chute assembly being raised and lowered under the command of a mis-scan controller.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

The present invention is used as part of a mailing system in which there is equipment for feeding sheets seriatim, accumulating the sheets into a stack of sheets, and folding the stack of sheets.

Figure 1:
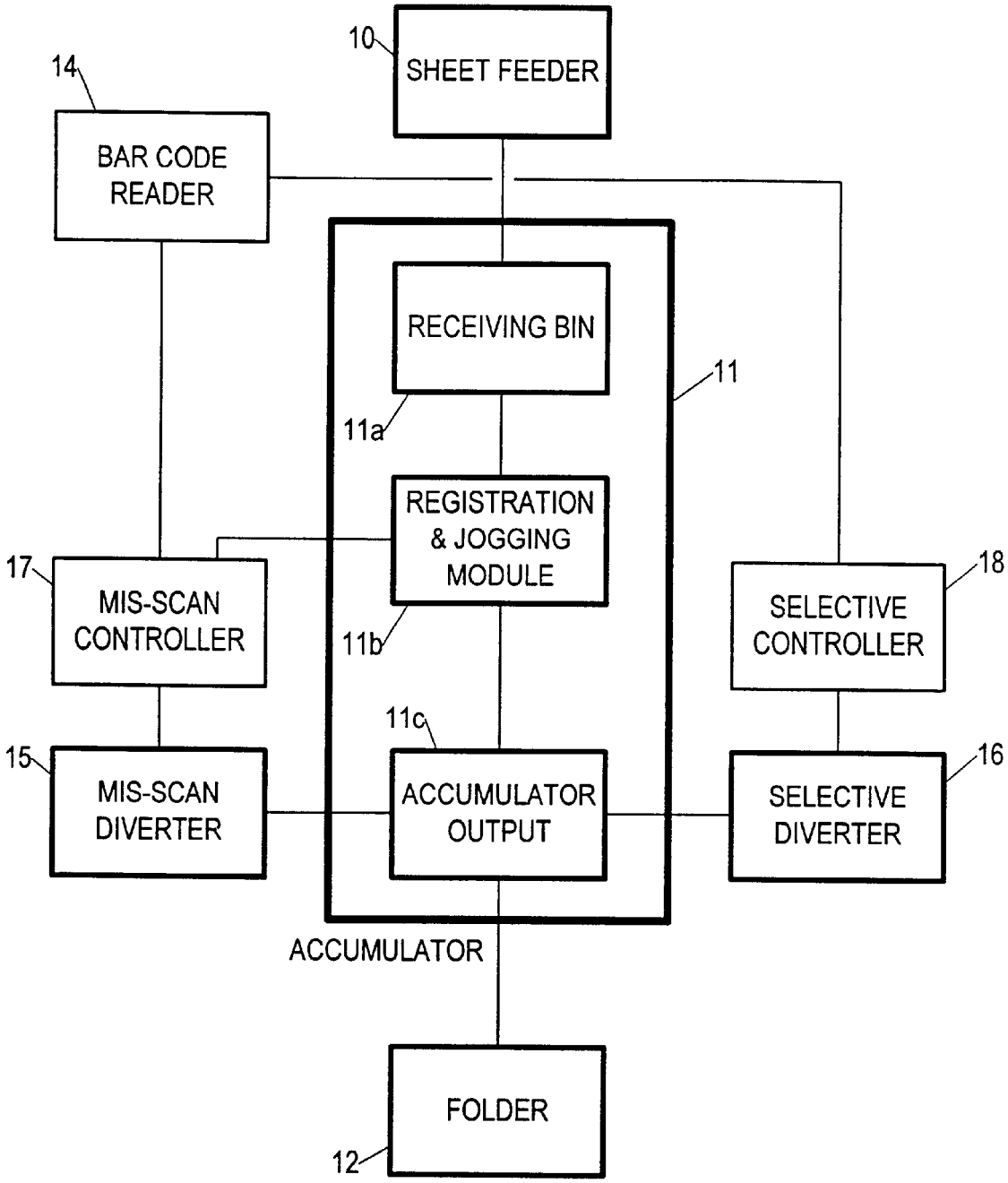
FIG. 1 is a block diagram of a system for accumulating and diverting sheets according to the present invention.

Referring now to FIGS. 1, in the preferred embodiment, the present invention includes: a sheet feeder 10 for feeding sheets seriatim: a receiving bin 11*a* for receiving and stacking the sheets in a bin; a registration and jogging module 11*b* for stopping the sheets over the receiving bin so that they fall properly into the bin, further for edge-aligning the sheets in the bin; and still further for feeding sheets out of the receiving bin into a normal feed path leading to for example a folder module 12 for folding the sheets as a stack. In addition, according to the preferred embodiment of the present invention, there are also two diverters, each coupled to the receiving bin 11*b*. A mis-scan diverter 15 diverts sheets that have been mis-scanned, the mis-scanning being prompted by a mis-scanned controller 17. In addition, a selective diverter 16, under the control of the selective controller 18, is provided for diverting document sets of up to 16 pages in case the pages can not be folded. The two diverters controllers 17 18 are each coupled to a bar code reader 14.

Figure 2:
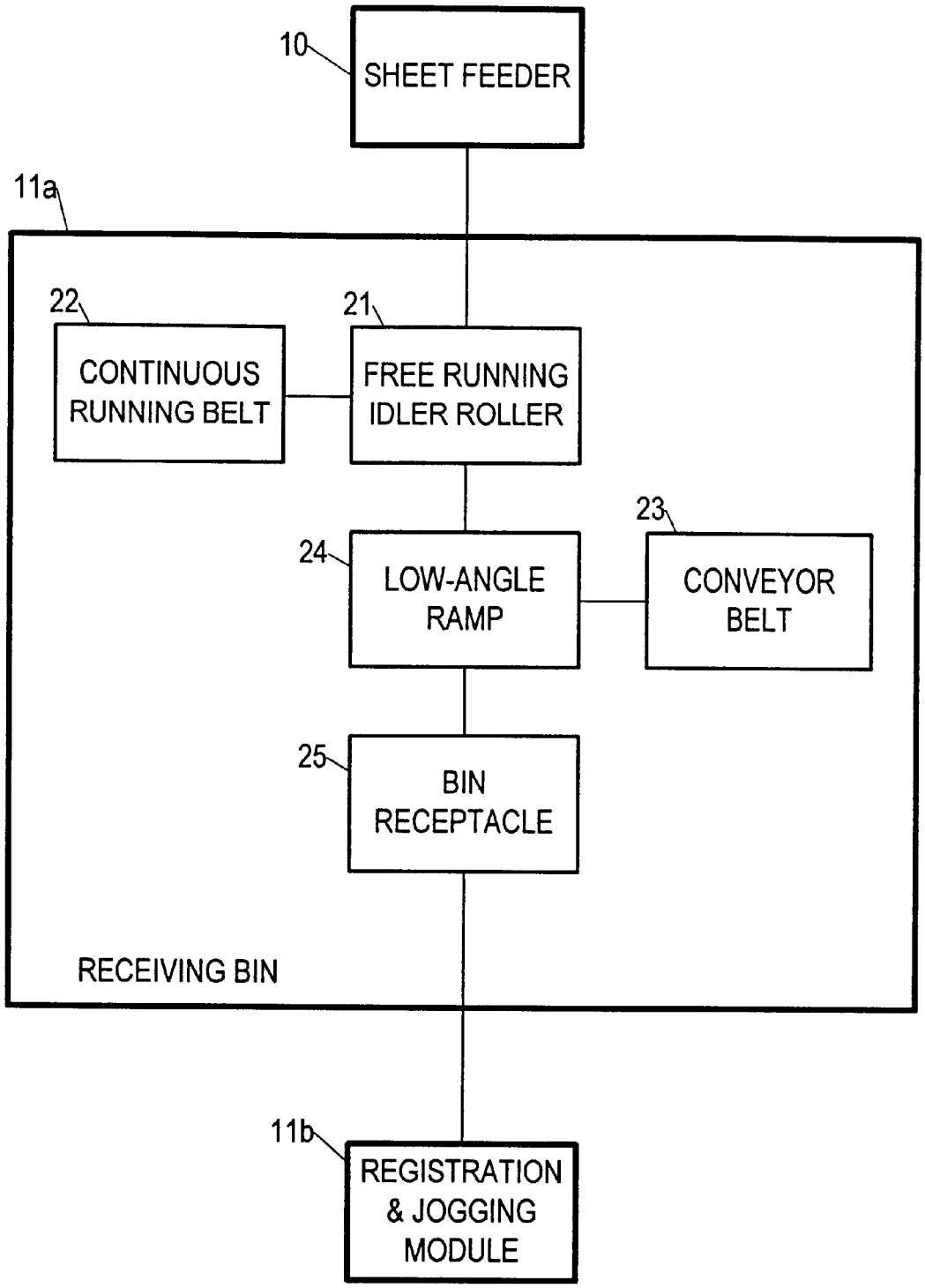
FIG. 2 is a block diagram showing in more detail a receiving bin of the system of FIG. 1.
Figure 5:
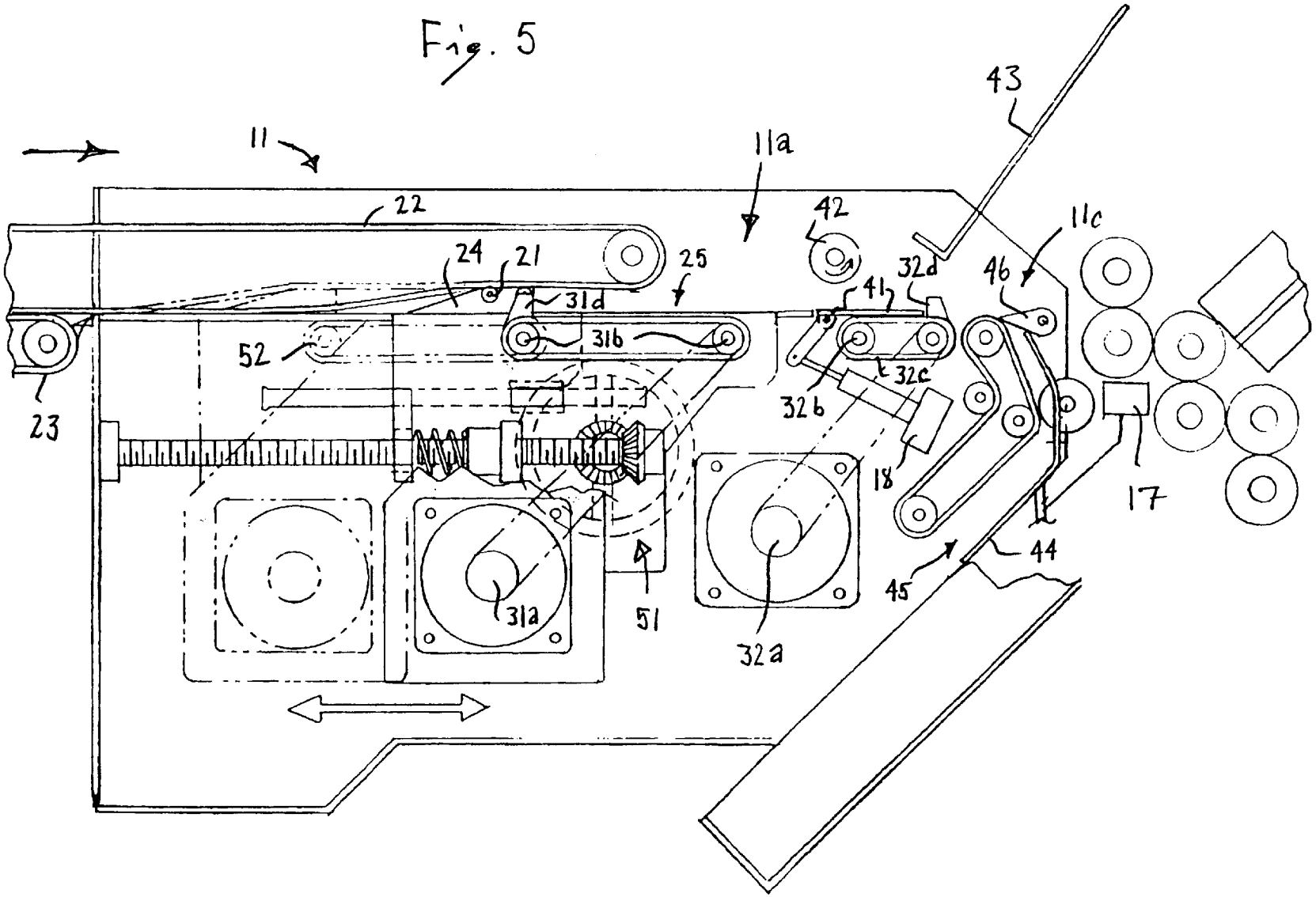
FIG. 5 is an elevation view of the accumulator and diverting mechanisms of the present invention.

Referring now to FIG. 2 and FIG. 5, the receiving bin 11*a* of the accumulator 11 is shown in more detail as including a free running idler roller 21 mounted on a low-angle ramp 24, which is provided with sheets of paper seriatim by conveyor belt 23. As the sheets move up the low-angle ramp 24 (even when the leading edge of a sheet reaches the top of the low-angle ramp, the trailing edge is still being pushed by rollers on an upstream module), the free running idler roller 21 forms a nip with a continuous running belt 22, pulling the sheets into a bin receptacle 25. The low-angle ramp 24 is securely held in a machine frame (not shown) and moves back and forth in the direction of paper travel. The sheets accumulate in the bin until a collation is completed. Because of the low-angle ramp, the sheets are provided in a substantially planar feed path that reduces the chance of a jam in the area of contact with the free running idler roller 21 and the continuous running belt 22. As indicated in FIG. 5, the width of the bin receptacle 25 can be adjusted to accommodate sheets of different lengths. A rack and pinion assembly 51 is provided to adjust the length of the bin receptacle 25, allowing an operator to adjust the location of the pusher rollers 31*b* over a range of positions including one in which the upstream pusher roller is located as shown by the ghost upstream pusher roller 52.

Figure 3:
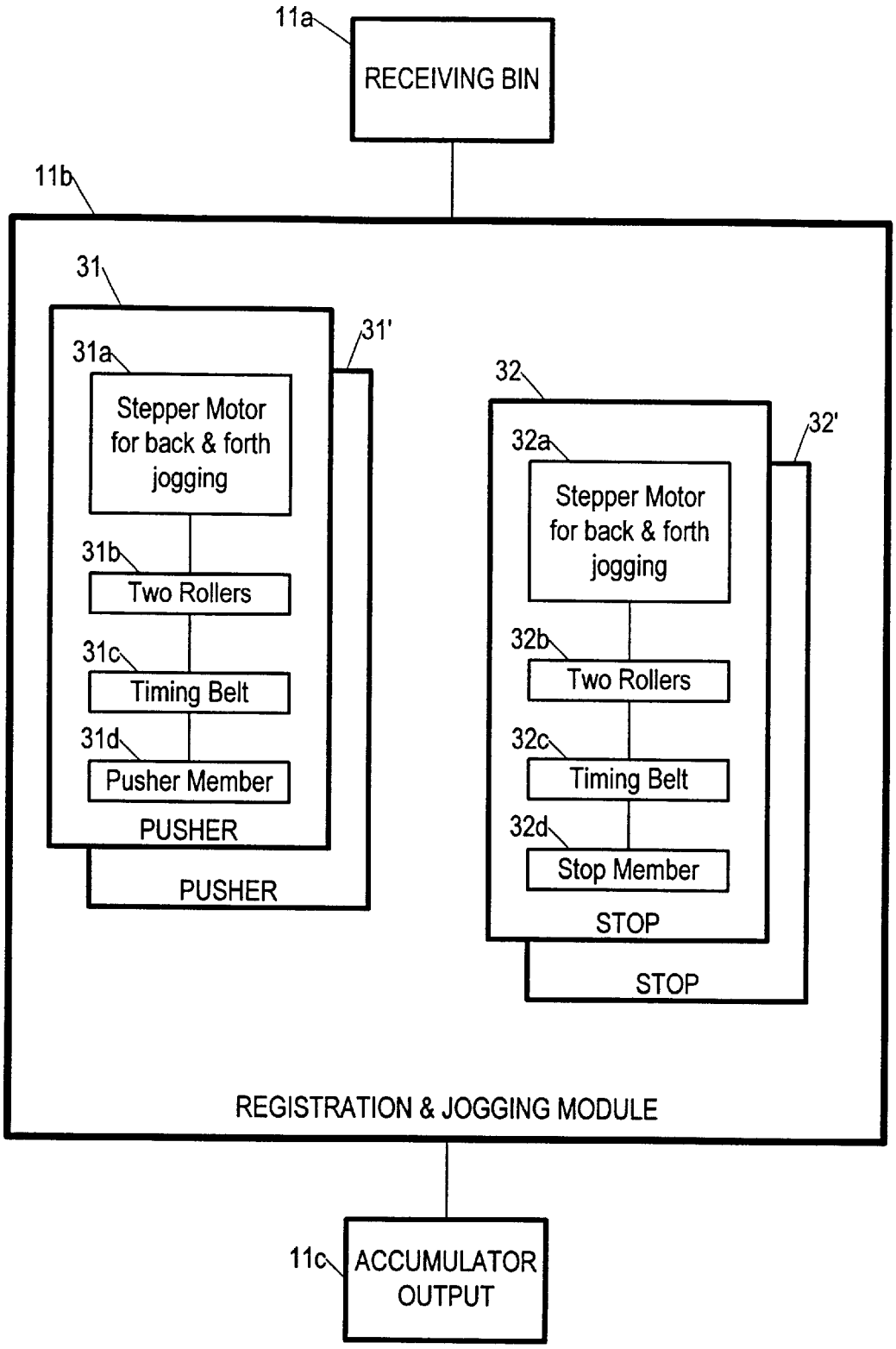
FIG. 3 is a block diagram showing in more detail a registration and jogging module of the system of FIG. 1.

Referring now to FIG. 3 and again to FIG. 5, the registration and jogging module 11*b* is shown in more detail as including one or more pusher assemblies 31 31', and one or more stop assemblies 32 32'. Each pusher assembly 31 31' includes a stepper motor 31*a* for back and forth jogging of the sheets accumulating in the receiving bin 11*a,* and two rollers 31*b* driven by the stepper motor 31*a* via the timing belt 31*c*. At least one pusher member 31*d* is located on the timing belt 31*c*. Each stop assembly 32 32' also includes a stepper motor 31*a* for back and forth jogging, and two rollers 32*b* driven by the stepper motor 32*a* via the timing belt 32*c*. At least one stop member 32*d* is affixed to the timing belt 32*c* and is disposed so that as sheets are fed into the receiving bin 11*a* they strike the stop members 32*d* and fall into the bin where they are then jogged and edge-aligned in preparation for their being folded (after all of the sheets of collation are accumulated). The distance between the pusher modules 31 31' and the stop modules 32 32' is automatically adjusted when an operator adjusts the length of the bin receptacle 25 using the rack and pinion assembly 51, as explained above.

Referring now to FIG. 4 and again to FIG. 5, the two diverters 15 16 are shown in more detail. The selective diverter 16 includes a pivot table by-pass guide 41 positioned according to commands received from a selective controller 18 (FIG. 1 and FIG. 5) so as to selectively divert a collation. At the distal end of the pivot table by-pass guide 41, there is a nip provided by a continuously running cooperating roller 42 and the surface of the pivot table by-pass guide 41. A sheet entering the nip so formed is pulled out of the regular path to an alternate path conveyor feed 43.

Figure 4:
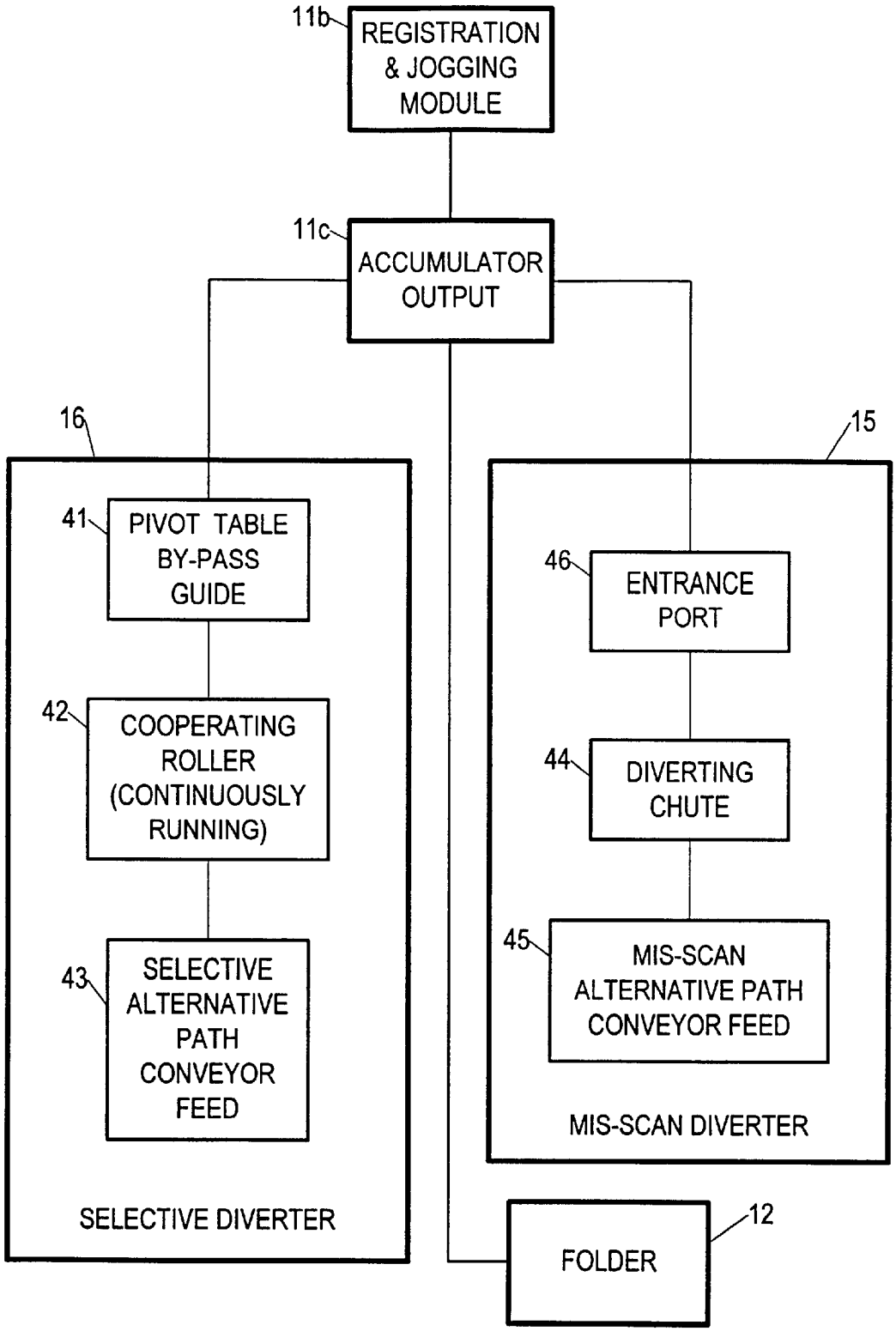
FIG. 4 is a block diagram showing in more detail two different kinds of diverter, each kind included in the system of FIG. 1.

Still referring to FIG. 4, the mis-scan diverter 15 includes a diverting chute assembly 44 that is made to rise up into the regular path, pushing open an entrance port 46, so that a sheet enters it and is thereby provided to a mis-scan alternate path conveyor feed 45. The diverting chute assembly 44 is raised and lowered under the command of the mis-scan controller 17 (FIG. 1 and FIG. 5). The mis-scan diverter 15 is downstream (after) the receiving bin of the accumulator and yet is still able to be used to divert a single sheet because in case of receiving an indication of a mis-scan from the bar code reader 14, the mis-scan controller 17 causes a signal to be applied to the registration and jogging module 11*b* commanding that the stop members 32*d* (FIG. 3) used to cause an incoming sheet to fall into the bin receptacle 25 (FIG. 2) not be raised. Thus, the mis-scanned incoming sheet passes over the bin receptacle 25 on its way to the mis-scan diverter 15 including the diverting chute assembly 44. In case of a collation of more than one sheet, the mis-scan controller 17 will not only divert the mis-scanned sheet, but will also divert each next sheet up until the next sheet that corresponds in a collation to the mis-scanned sheet. Thus, in the preferred embodiment, one entire collation is mis-scanned in case of a single mis-scanned sheet.

In an alternative embodiment of the mis-scan diverter 15 and mis-scan diverter controller 17, the mis-scan diverter controller 17 does not command the stop members 32*d* (FIG. 3) of the registration and jogging module 11*b* to remain in the lowered position when a mis-scanned sheet is detected. Instead, the mis-scan diverter controller 17 diverts the entire collation including the mis-scanned sheet, accumulated in the bin receptacle 25. Thus, again, an entire collation is diverted in case of a mis-scanned sheet.

Figure 6:
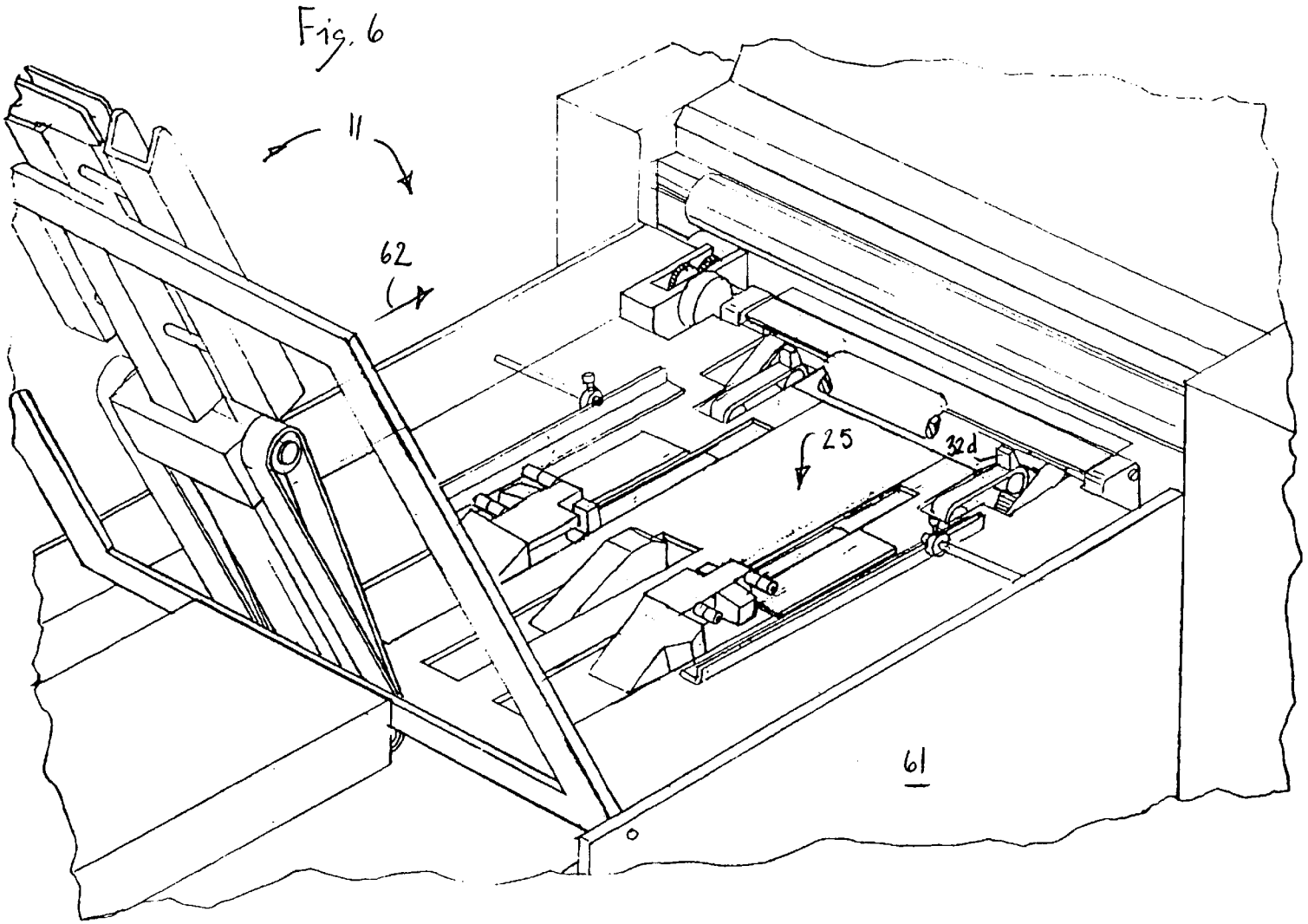
FIG. 6 is a perspective drawing of the accumulator generally, shown in a housing.

Referring now to FIG. 6A, the accumulator 11 is shown generally in a housing 61. The accumulator 11 is opened to show the bin receptacle 25 and stop members 32*d*. The path of sheets is indicated by an arrow 61.

Figure 7:
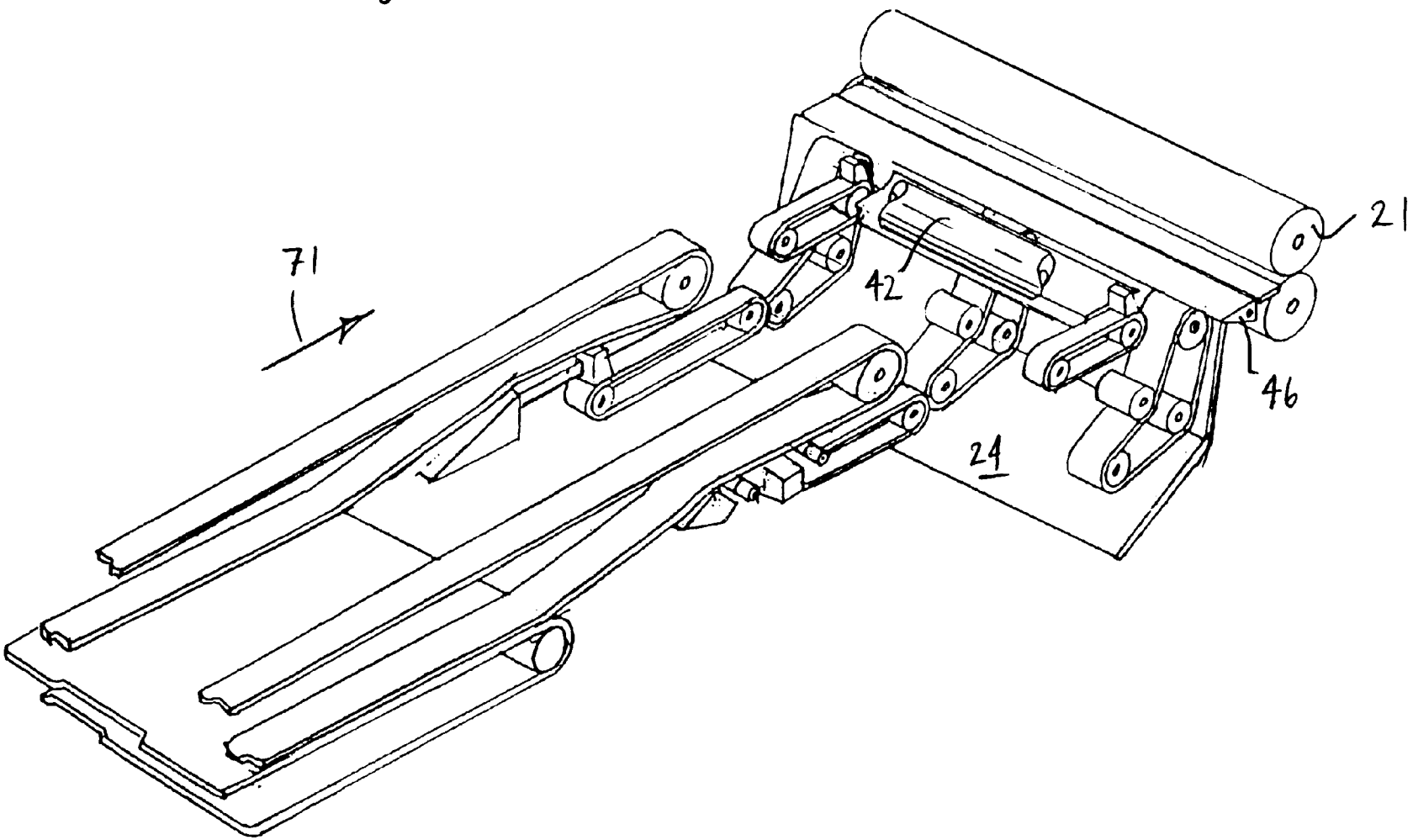
FIG. 7 is a perspective drawing showing parts of the accumulator and showing parts of the diverting mechanisms.

Referring now to FIG. 7, various elements of the accumulator 11 are shown including the free-running idler roller 21, the continuously running cooperating roller 42 of the selective diverter 16, the mis-scan diverter entrance port 46, and the low-angle ramp 24. The path of sheets is indicated by an arrow 71.

Figure 8A:
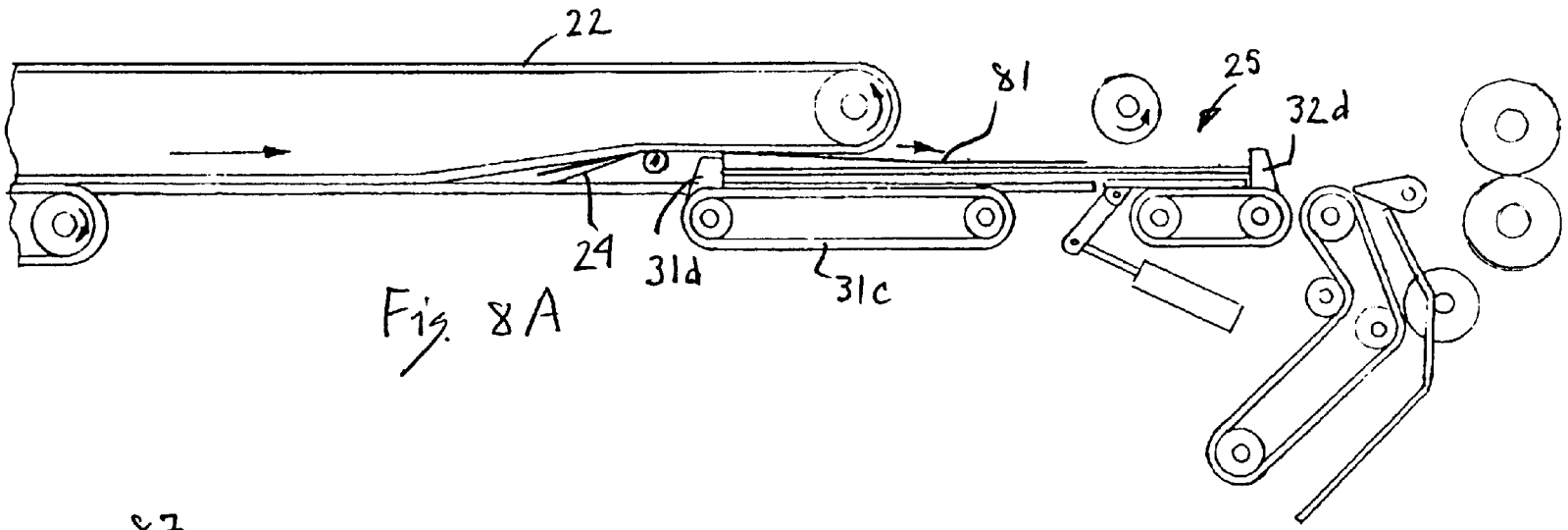
FIG. 8A is a schematic showing a sheet feeding into a bin receptacle.

Referring now to FIG. 8A, a schematic shows the action of various elements of the accumulator 11. A sheet 81 enters the bin receptacle 25 by moving up the low-angle ramp 24 under the influence of the continuously running belt 22.

Figure 8B:
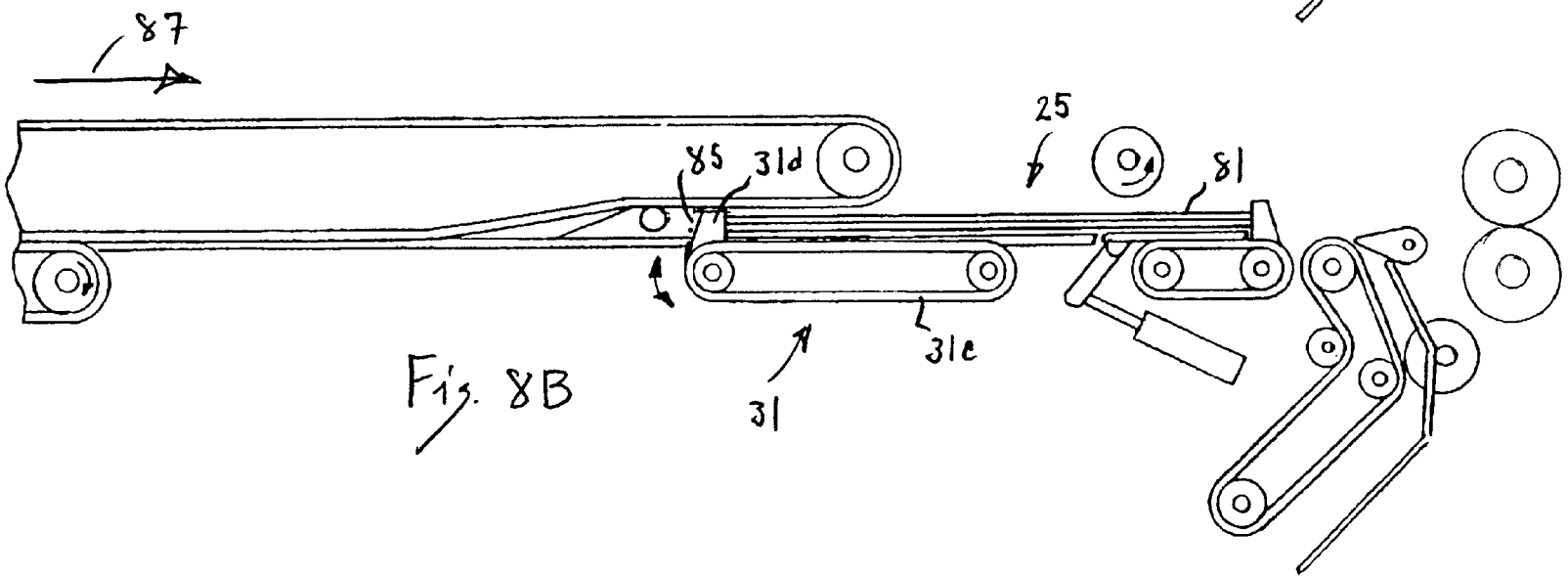
FIG. 8B is a schematic showing sheets in the bin receptacle of FIG. 8A being agitated so as to be properly edge-aligned.

Referring now to FIG. 8B, a schematic shows the edge-aligning of sheets in the bin receptacle 25. The sheet 81 in the bin receptacle 25 is edge-aligned by the registration and jogging module 31 including a timing belt 31*c* causing the pusher member 31*d* to move back and forth in the direction of travel of a sheet (indicated by an arrow 87). The pusher member thus moves back and forth in agitating the sheet 81, and the other sheets in the bin receptacle 25, so as to periodically occupy a location indicated by ghost pusher member 85.

Figure 9A:
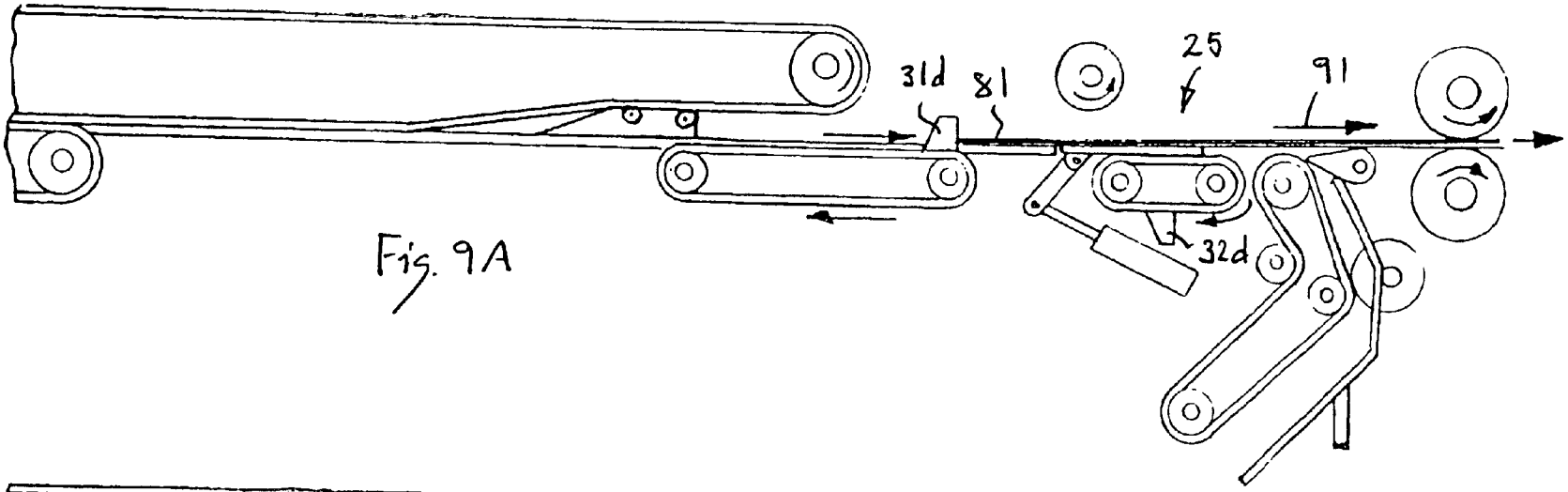
FIG. 9A is a schematic showing sheets being ejected from the bin receptacle of FIG. 8B so as to be conveyed to a nip for feeding to a downstream module, such as a folder.

Referring now to FIG. 9A, a schematic shows a collation being ejected from the bin receptacle 25. The sheet 81 as well as the other sheets in an accumulated collation in the bin receptacle 25 are pushed out of the bin receptacle 25 by the pusher member 31*d* into a normal path (indicated by an arrow 91) leading to a downstream module such as a folder 12 (FIG. 1). Prior to the pusher member 31*d* pushing the collation out of the bin receptacle 25, the stop member 32*d* is caused to rotate to a downward position, out of the normal path.

Figure 9B:
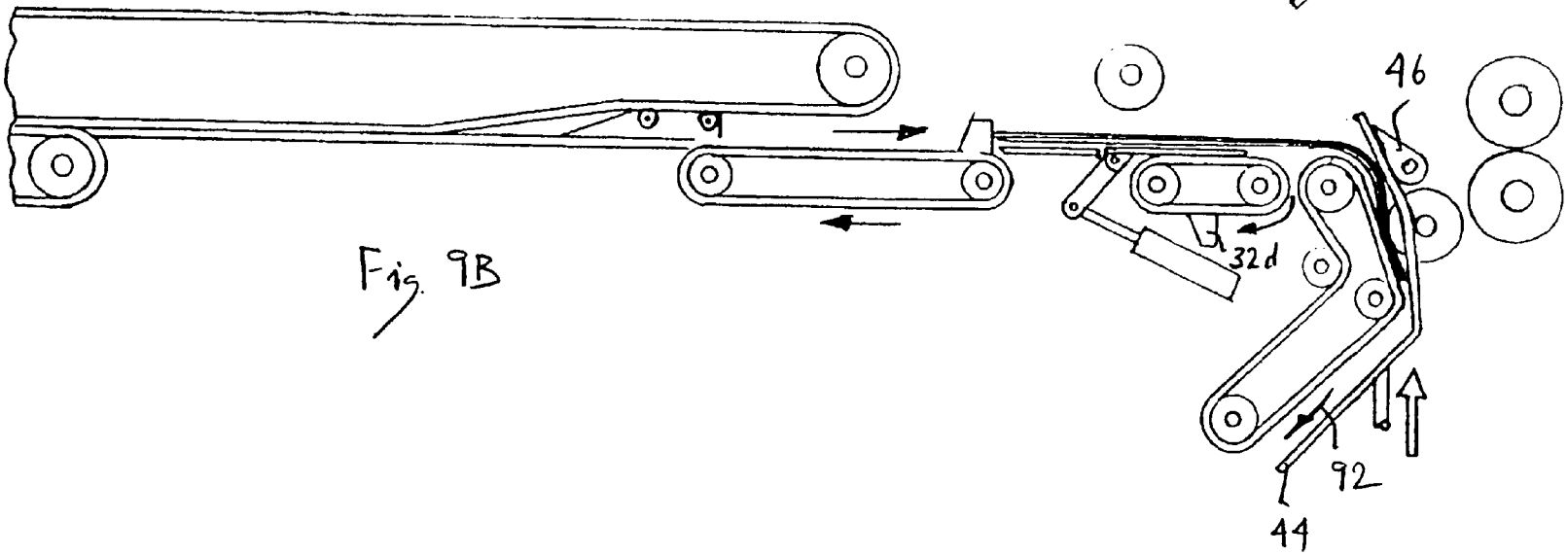
FIG. 9B is a schematic showing a sheet being diverted by a mis-scan diverter.

Referring now to FIG. 9B, a schematic shows a collation being diverted by the mis-scan diverter 15 (for the embodiment in which the mis-scan diverter diverts an entire collation at a time). The sheet 81 as well as the other sheets in an accumulated collation in the bin receptacle 25 are pushed out of the bin receptacle 25 by the pusher member 31*d* into a mis-scan diverter path (indicated by an arrow 92). Prior to the pusher member 31*d* pushing the collation out of the bin receptacle 25, the stop member 32*d* is caused to rotate to a downward position. To cause the mis-scan diverting, the diverting chute 44 is caused to rise up, pushing open the entrance port 46 to the mis-scan alternate path. In case of the embodiment in which individual sheets are diverted by the mis-scan diverter, the sheets to be diverted are not stopped by the stop member 32*d* (which is caused to remain in the downward position for such a diverting), and instead strike the open entrance port 46 and so enter the diverting chute 44.

Figure 10:
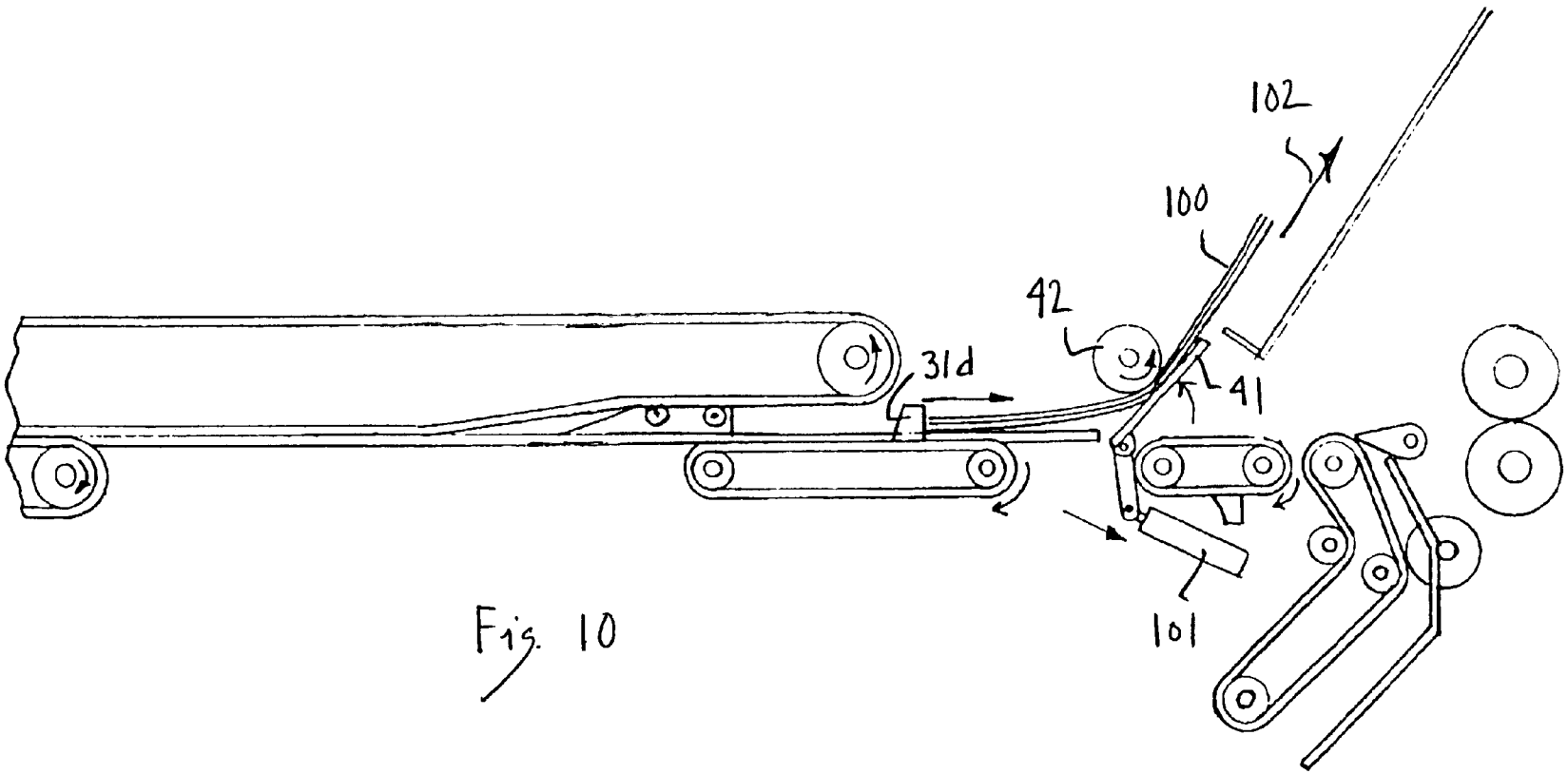
FIG. 10 is a schematic showing a collation being diverted by a selective diverter.

Referring now to FIG. 10, a schematic shows a collation 100 being diverted by the selective diverter 16 to a selective diverter alternate path indicated by an arrow 102. For the selective diverting, the pivot table by-pass guide 41 is caused to rotate upward (under the action for example of a solenoid 101) into the indicated orientation, and the pusher member 31*d* drives the collation 100 out of the bin receptacle 25 into the nip created by the mating of the surface of the pivot table by-pass guide 41 and the continuously running cooperating roller 42.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A system for accumulating sheets as part of the operation of a mailing system and for conveying the sheets along a normal feed path, the system comprising:

a) a sheet feeder for feeding sheets seriatim;

b) a bar code reader, responsive to bar code indicia on the sheets, for providing a bar code scanned signal;

c) a receiving bin for receiving and stacking the sheets in a bin receptacle, said receiving bin including a free running idler roller mounted on a low-angle ramp that rises toward a continuously running belt, the free running idler roller mounted at an end of the low-angle ramp closest to the continuously running belt to form a nip with the continuously running belt and provide sheets to the receiving bin in a substantially planar feed path;

d) a registration and jogging module for stopping the sheets over the receiving bin so that they fall properly into the bin receptacle, and further for edge-aligning the sheets in the bin receptacle, and still further for ejecting sheets out of the receiving bin along the normal feed path;

e) a mis-scan controller, responsive to the bar code scanned signal, for providing mis-scan diverter commands for sheets that have been mis-scanned;

f) a mis-scan diverter, coupled to the receiving bin, responsive to the mis-scan diverter commands, for diverting those sheets that have been mis-scanned from the normal feed path to a first alternate path;

g) a selective controller, responsive to the bar code scanned signal, for providing selective diverter commands for diverting sheets selectively; and h) a selective diverter, coupled to the receiving bin, responsive to the selective diverter commands, for diverting selective document sets from the normal feed path to a second alternate path.

2. A system as in claim 1, wherein the registration and jogging module comprises:

a) a pusher assembly including a stepper motor for back and forth jogging of the sheets accumulating in the receiving bin, and two rollers driven by the stepper motor via a timing belt, and also including at least one pusher member located on the timing belt; and b) a stop assembly including a stepper motor for back and forth jogging, and two rollers driven by the stepper motor via the timing belt, and also including at least one stop member affixed to the timing belt and disposed so that as sheets are fed into the receiving bin they strike the stop member and fall into the bin receptacle where they are then jogged and edge-aligned.

3. A system as in claim 1, wherein the accumulator further comprises a rack and pinion assembly coupled to the pusher members, and wherein the length of the receiving bin is adjustable by an operator, using the rack and pinion assembly, so as to accommodate sheets of different length.

4. A system as in claim 1, wherein the selective diverter includes a pivot table by-pass guide positioned according to commands received from a selective controller so as to selectively divert a sheet, wherein a nip is formed at the distal end of the pivot table by-pass guide by a continuously running cooperating roller and a surface of the pivot table by-pass guide, so that a sheet entering the nip so formed is diverted to the second alternate path.

5. A system for accumulating sheets as part of the operation of a mailing system and for conveying the sheets along a normal feed path, the system comprising:

a) a sheet feeder for feeding sheets seriatim;

b) a bar code reader, responsive to bar code indicia on the sheets, for providing a bar code scanned signal;

c) a receiving bin for receiving and stacking the sheets in a bin receptacle;

d) a registration and jogging module for stopping the sheets over the receiving bin so that they fall properly into the bin receptacle, and further for edge-aligning the sheets in the bin receptacle, and still further for ejecting sheets out of the receiving bin along the normal feed path;

e) a mis-scan controller, responsive to the bar code scanned signal, for providing mis-scan diverter commands for sheets that have been mis-scanned, the mis-scan controller further providing stop-member commands for indicating that stop members of the receiving bin are to remain in a lowered position, the registration and jogging module being responsive to the stop-member commands;

f) a mis-scan diverter, coupled to the receiving bin, responsive to the mis-scan diverter commands, for diverting those sheets that have been mis-scanned from the normal feed path to a first alternate path, the mis-scan diverter including a diverting chute assembly that rises up into the feed path so that a sheet enters the diverting chute assembly and is thereby provided to the first alternate path, the diverting chute assembly being raised and lowered under the command of the mis-scan controller;

g) a selective controller, responsive to the bar code scanned signal, for providing selective diverter commands for diverting sheets selectively; and h) a selective diverter, coupled to the receiving bin, responsive to the selective diverter commands, for diverting selective document sets from the normal feed path to a second alternate path.

* * * * *